United States Patent [19]

Bossuet et al.

[11] 4,243,055

[45] Jan. 6, 1981

[54] METHOD AND DEVICE FOR WRAPPING CLOSED TIP CIGARS

[75] Inventors: Jean Bossuet, Carbon Blanc; Jean Godet, Bordeaux; Jean-François Guiton, Bordeaux; René Sizarol, Bordeaux; Pierre Waegaert, Bordeaux, all of France

[73] Assignee: Service d'Exploitation Industrielle des Tabacs et des Allumettes, Paris, France

[21] Appl. No.: 17,107

[22] Filed: Mar. 5, 1979

[30] Foreign Application Priority Data

Mar. 9, 1978 [FR] France ..... 78 06789

[51] Int. Cl.[3] ..... A24C 1/30; A24C 1/32

[52] U.S. Cl. ..... 131/76; 131/88

[58] Field of Search ..... 131/76, 77, 58, 26, 131/105, 29, 33, 67, 20 R, 89

[56] References Cited

U.S. PATENT DOCUMENTS

| | | | |
|---|---|---|---|
| 3,105,497 | 10/1963 | Petri et al. | 131/105 X |
| 3,160,160 | 12/1964 | Maas et al. | 131/29 |
| 3,225,772 | 12/1965 | Godfrey et al. | 131/20 R X |

*Primary Examiner*—Stephen C. Pellegrino

*Attorney, Agent, or Firm*—Holman & Stern

[57] ABSTRACT

A method for mechanically wrapping closed tip cigars of the type in which the bunches are wound in the normal direction of the machine used when wrappers are to be employed which are cut out from a half-leaf corresponding to the "type" of the machine, i.e. "right-hand" or "left-hand", and said bunches are wound in the direction opposite said normal direction when wrappers are to be employed which are cut out from a half-leaf not corresponding to the type of the machine, wherein, in this latter case, a shaper is used for covering the tip of said bunches, which shaper has the characteristics of a shaper belonging to a machine of a type contrary to that of the machine used.

5 Claims, 12 Drawing Figures

METHOD AND DEVICE FOR WRAPPING CLOSED TIP CIGARS

BRIEF DESCRIPTION OF THE INVENTION

The present invention relates to the manufacture of cigars and more particularly to the wrapping thereof, i.e. the operation which consists in applying to the cigar bunch the piece of outer leaf of tobacco or wrapper which outwardly envelops this bunch and gives it an as attractive presentation as possible. The invention relates more particularly to the mechanical wrapping of closed tip cigars, i.e. those for which the end of the cigar which is placed between the lips (tip) is covered (or almost entirely covered) by the terminal part of the wrapper. As wrapping is very generally effected in a helix, it is usually terminated at the tip of the cigar: this makes it possible not to stick the wrapper, except at the tip; this suffices to avoid the unwinding of the cigar whilst it is being smoked.

Closed tip cigars occupy the highest rank in the cigar hierarchy. Their finish must therefore be impeccable. This is why their mechanical manufacture was impossible until mechanisms capable of terminating the wrapping thereof, as well as an experienced worker, existed. Mechanisms of this type were already developed a long time ago by various cigar-manufacturing machine constructors and they have since given satisfaction to the producers. These mechanisms are all similar and comprise an assembly of perfectly fitting pieces which are added, on the cigar tip side, to the wrapping machines or "wrapping stations". The following always figure among these pieces: the first comprises a surface for supporting the end of the wrapper (or "flag") which, in the axial direction projects beyond the tip of the cigar just before the end of wrapping and must cover this tip; it may be a fixed piece which extends the smoothing plate; more often it is a cylindrical roller the rotation of this roller being controlled to conduct the wrapper end or "flag" at the desired speed, giving it the inflexion necessary for a correct application on the tip. The second, more essential, piece may be called tip "shaper". It may in fact serve not only to precisely position the filling of the cigar in the wrapping station (and, to this end, it is movable along the axis of this station) but also to oblige the wrapper end to take the shape which it is desired to give it. To this end, this piece remains fixed during the wrapping of the tip; it is then applied on the tip of the filling by its inner concave face and the end of the wrapper follows this concave surface and is applied to the tip of the filling. Furthermore, at the end of the shaper, a convex surface may serve as support for the end of the wrapper, between the moment when it leaves the cylindrical roller and the moment when it returns inside the shaper.

The harmonious functioning of this assembly obviously requires that the wrapper is wound in the direction provided by the constructor of the machine. Now, it has recently been shown, in Applicants' U.S. patent Ser. No. 889,204 of Mar. 23, 1978, that is might be advantageous to rotate the filling, in its wrapping station, in a direction opposite the direction provided by the constructor. In fact, this makes it possible immediately to use the half-leaves which, up to then, were unsuitable to be used correctly on the machine used: use of "left-hand" half-leaves on a "right-hand machine" or use of "right-hand" half-leaves on a "left-hand machine". This specialization of the machine, for one of the two classes of half-leaves, well known to cigar producers, will hereinafter be called the "type" of machine. As the direction of winding of the wrapper is determined by the direction of rotation of the filling, the method according to the above-mentioned Application could not be used for wrapping closed tip cigars. The main object of the present invention is to allow this technique to be used even in this latter case.

It is an object of the invention to provide a device and method for mechanically wrapping closed tip cigars of the type described in the above mentioned Application, i.e. in which the fillings are wound in the normal direction of the machine used when wrappers are used which are cut out from a half-leaf corresponding to the type of the machine and in which the fillings are wound in the direction opposite the normal direction of the machine used when wrappers are employed which are cut from a half-leaf not corresponding to the type of the machine, said device being characterised in that, in this latter case, a shaper is used for covering the tip of said fillers, having the features of a shaper belonging to a machine of a type contrary to that of the machine used.

Two tip shapers may be mounted on the machine used and one or the other of the shapers is used depending on the direction of rotation of the filler.

One shaper only may also be mounted on the machine used and the end of the wrapper may be made to present itself differently in the shaper depending on the direction of winding of the wrapper around the filler.

The invention also lies in various devices for carrying out the above-mentioned methods. These devices comprise in common means for causing a cigar filling to rotate on itself, means for conducting a wrapper to the first means so that it is wound from the foot to the tip of the filling and at least one shaper for applying the wrapper on the tip of the filling so as to close this tip, these different means being of known type.

In one embodiment of the devices according to the invention, a member is provided, carrying two tip shapers of different designs and means for actuating this member as a function of the direction of rotation imparted to the means for rotating the filling on itself, so that the shaper adapted to said direction of rotation is brought in the axis and in the vicinity of said means to rotate the filling.

In the other embodiment of the device according to the invention, one tip shaper only is provided.

According to one category of the above devices, this shaper is provided to be able to rotate by about a quarter turn about an axis parallel to the axis of rotation of the filling before being applied to the tip thereof, so as to present at the end of the wrapper having to cover said tip an inlet opening in the shaper exactly adapted to the path of said end, as a function of the direction of rotation of the filling. This adaptation to the direction of rotation may concern both the orientation of the opening and the shape of the convex surfaces which limit it and serve as support for the wrapper end during its entrance into the shaper.

According to another category of the above devices, the single shaper has at the same time features of the shapers belonging to "right-hand" and "left-hand" machines.

It may possess a wide inlet opening for the end of the wrapper, limited on either side by two convex surfaces adapted for guiding the wrapper end in one and the other direction of rotation of the filling. This opening may thus extend over more than 180° in a plane perpendicular to the axis of the filling in rotation.

The shaper may thus be located entirely below the horizontal plane passing through said axis of rotation, with the exception of a catch serving for the suitable engagement of the wrapper end and located near a recess corresponding to the passage through the shaper by the axis of rotation of the filling.

This catch will preferably be opposite the piece supporting the end of the wrapper, with respect to said axis.

DETAILED DESCRIPTION OF THE SEVERAL VIEWS OF THE DRAWING

The invention will be more readily understood on reading the following description with reference to the accompanying drawings, in which:

FIGS. 1 and 1*a* are plan views of the pieces forming the tips of cigars as mounted on a conventional machine which, in the present case, is a left-hand machine;

Figure 6:
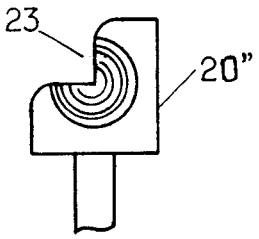
Figure 6A:
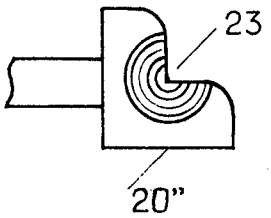
Figure 7A:
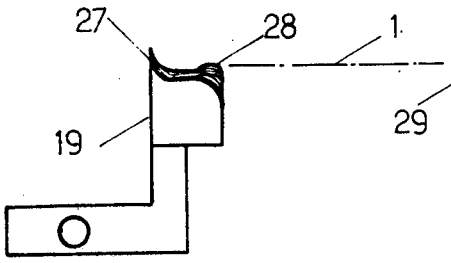
Figure 7C:
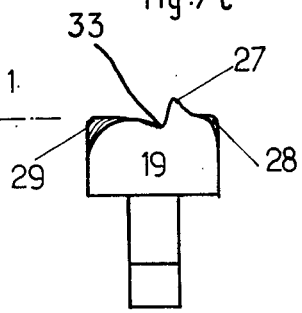
Figure 7D:
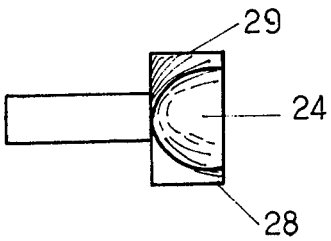
Figure 7B:
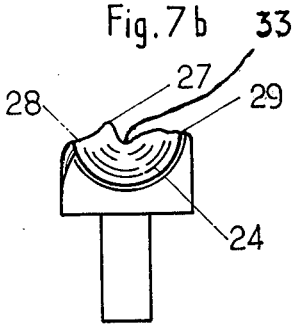

FIGS. 6 and 6*a* are views from inside the wrapping station, of a shaper with orientable inlet opening;

FIGS. *7a, 7b, 7c* and *7d* are respectively side, inside and end elevations and the plan view of another type of shaper according to the invention.

Figure 2:
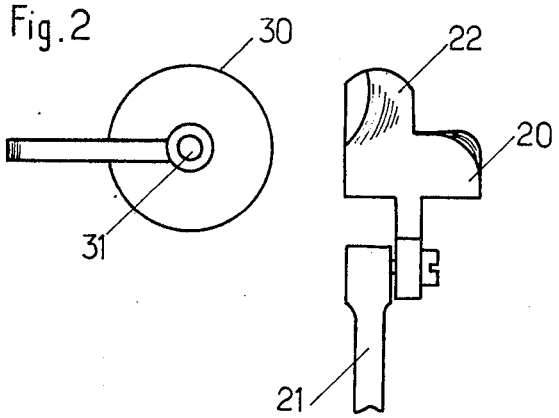
FIGS. 2 and 3 are end and inside elevations respectively, with respect to the wrapping station, of the same pieces.
Figure 3:
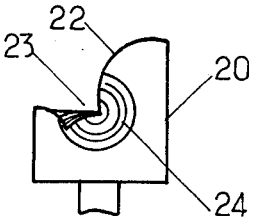
Figure 1:
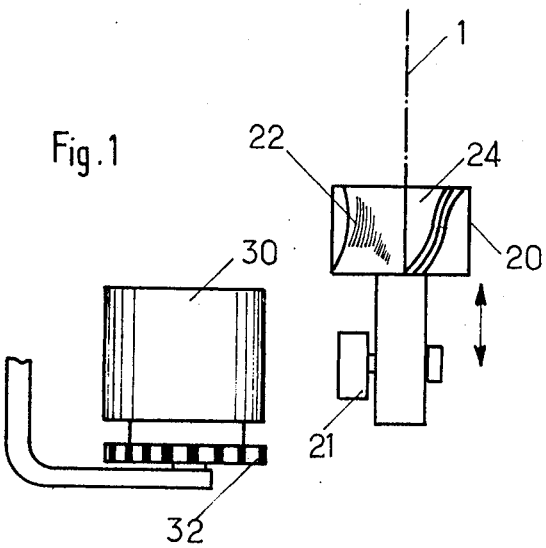

Referring now the drawings, FIGS. 1 to 3 show the arrangement of the main pieces for shaping the tip of the closed tip cigars on modern machines. The bunch rotates in a wrapper station (not shown) about the axis 1, in the direction of the curved arrow of FIG. 1*a*. The tip shaper 20 is applied on the tip of the filling and determines the exact location of the latter along the axis of the wrapping station by exerting a slight thrust in the direction of the ascending arrow of FIG. 1. This movement of the shaper is given thereto by the lever 21, controlled by a special cam. The support roller 30 then moves towards the shaper and occupies the position shown in FIG. 1*a*. When the end of the wrapper, wound progressively on the cigar, occupies the position which by the broken line in this Figure, it is detached from the conveyor and the wrapper end rests, by its gummed face, on the roller 30. Said latter is then driven in rotation about its axis 31 by the toothed wheel 32, in the direction of the arrow in FIG. 1*a*. The toothed wheel 32 rotates under the influence of a rack which is carried by the wrapper conveyer and which meshes therewith. The end of the wrapper passes over the convex boss 22 of the shaper 20 and penetrates in the shaper by its opening 23, taking with it the wrapper end correctly oriented by the roller 30 and applied to the tip of the bunch by the inner concavity 24 of the shaper 20.

Figure 1A:
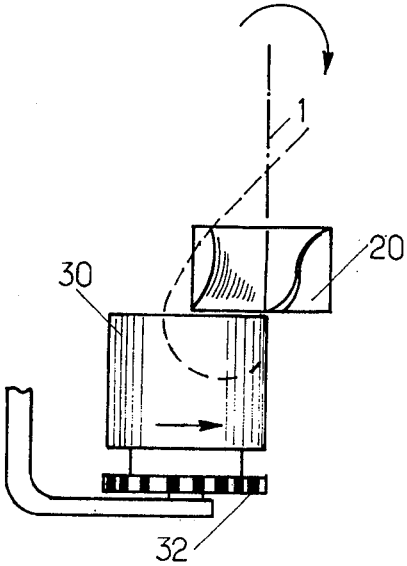

It will be appreciated that if the bunch rotates in the direction opposite that shown by the curved arrow of FIG. 1*a*, matters would not be as good. In particular, the end of the wrapper which has to turn back, would scrape on the edge joining the inner concavity 24 and the convex boss 22 of the shaper. The taking along of the wrapper end would not be ensured either due to the inflexion which the cylindrical roller would give it, in the contrary direction to that imparted by the rotation of the bunch.

Figure 4:
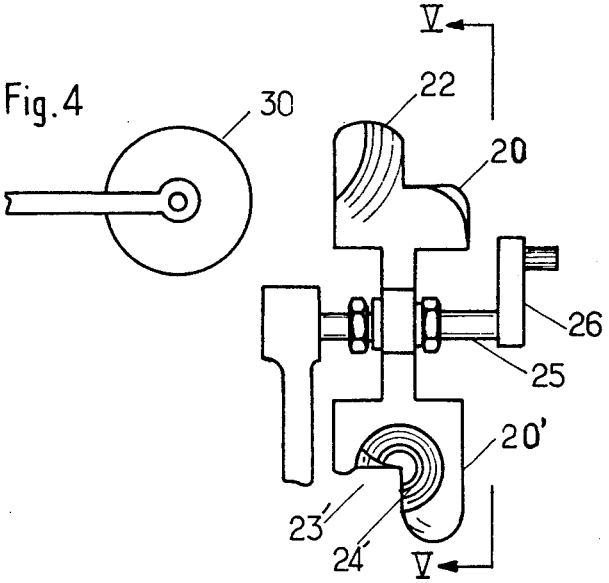
FIGS. 4 and 5 are respectively an end elevation and side view along V—V of the same pieces for a machine with two shapers.
Figure 5:
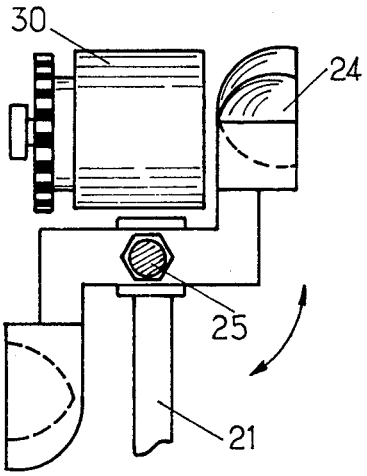

According to FIGS. 4 and 5, this drawback is obviated by mounting two shapers 20 and 20′ near the wrapping station. The shaper 20, shown in the axis of the station, is identical to that of a left-hand machine and is suitable when the machine rotates in its normal direction. The shaper 20′ has the geometrical characteristics of a shaper of a right-hand machine. By rotating about the axis 25, said rotation controlled by the lever 26, it may replace the shaper 20 (and vice versa) as indicated by the double arrow of FIG. 5. The inlet opening for the wrapper 23′ then takes the place of the convex boss 22, the inner concavities 24′ and 24 partially substituting each other.

According to FIGS. 6 and 6*a*, one shaper is provided which is capable, in addition to its reciprocating movement in the directions of the double arrow of FIG. 1, of a rotation about the geometrical axis of the wrapping station. By rotating through a quarter turn about this axis, this shaper 20″ may present its inlet 23 either in the upper left-hand quadrant or in the upper right-hand quandrant, seen from inside the wrapping station. This presentation may suit, with a few other arrangements, if necessary, for winding bunches rotating either in the normal direction or in opposite direction.

FIGS. *7a* to *7d* show the same shaper for left-hand machine, adapted to be used in the two possible directions of rotation. Although it is mounted on a left-hand machine, it has the characteristic, common to all the shapers of right-hand machines, of having, when it is seen from inside the wrapping station, as in FIG. *7b*, a protuberance in the upper left-hand quadrant. This protuberance is, however, reduced here to a catch 27, connecting progressively with a convex surface 28. The inner concavity 24 is also connected with this convex surface 28 and with another convex surface 29, entirely below the horizontal plane passing through the axis 1 of the wrapping station, which is substituted for the boss 22 of the support of the end of the wrapper. Apart from the catch 27, the whole of the shaper is located below the horizontal plane defined hereinabove. The opening for entrance of the wrapper in the shaper therefore extends over more than 180° around the axis 1 of rotation of the bunch. A small recess 33 will be noted near the catch 27, surrounding the trace of the axis 1 on the base plane 19 of the shaper, which recess facilitates penetration of the wrapper end in the shaper.

What is claimed is:

1. A device for mechanically wrapping closed tip cigars of the type in which the bunches are wound in the normal direction of the machine used when wrappers are to be employed which are cut out from a half-leaf corresponding to the "type" of the machine, i.e. "right-hand" or "left-hand", and said bunches are wound in the direction opposite said normal direction when wrappers are to be employed which are cut out from a half-leaf not corresponding to the type of the machine, said device comprising means for rotating a cigar bunch on itself, means for conducting a wrapper to the preceding means so that it is wound from the foot of said bunch to the tip thereof and shaping means for applying the end of the wrapper on the tip of said bunch so as to close said tip, wherein said shaping means comprise surfaces for guiding the end of the wrapper corresponding to the direction of guiding of the wrapper on the tip whatever this direction is.

2. A device as claimed in claim 1, wherein said shaping means comprises a piece carrying two different shapers and means for actuating this piece as a function of the direction of rotation imparted to the means for rotating the bunch on itself, so that the shaper which comes into contact with the tip of the filling is that which is adapted to said direction of rotation.

3. A device as claimed in claim 1, wherein said shaping means comprises one shaper only and means for rotating this shaper on itself by about a quarter turn before it is applied to the tip of the filling.

4. A device as claimed in claim 1, wherein said shaping means comprises a shaper having an inner concavity extending on each side by a convex surface for guiding the wrapper end, the inlet opening in the shaper extending over more than 180° in a plane perpendicular to the axis of rotation of the bunch.

5. A device as claimed in claim 4, wherein there is provided, in line with said inner concavity of the shaper, a catch projecting towards the inlet opening and located near a recess in the bottom of the concavity near its axis.

* * * * *